US006902412B2

(12) United States Patent
Higgins

(10) Patent No.: US 6,902,412 B2
(45) Date of Patent: Jun. 7, 2005

(54) APPARATUS FOR INTRINSICALLY SAFE POWER INTERFACE

(75) Inventor: Robert J. Higgins, Plantation, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/649,444

(22) Filed: Aug. 26, 2003

(65) Prior Publication Data

US 2005/0048816 A1 Mar. 3, 2005

(51) Int. Cl.[7] ..... H01R 4/66
(52) U.S. Cl. ..... 439/101
(58) Field of Search ..... 439/101, 60, 924.1, 439/630, 569, 567, 66, 88, 575, 181; 455/569, 567, 66, 88, 575

(56) References Cited

U.S. PATENT DOCUMENTS 4,849,944 A * 7/1989 Matsushita ..... 714/718
6,058,319 A * 5/2000 Sadler ..... 455/569.2
6,220,896 B1 * 4/2001 Bertoncini et al. ..... 439/608
6,263,218 B1 * 7/2001 Kita ..... 455/567
6,397,087 B1 * 5/2002 Kim et al. ..... 455/569.1
6,509,659 B1 * 1/2003 Carroll et al. ..... 307/125
6,539,241 B1 * 3/2003 Sakanoue et al. ..... 455/567
6,642,614 B1 * 11/2003 Chen ..... 257/690
6,669,487 B1 * 12/2003 Nishizawa et al. ..... 439/60
6,677,772 B1 * 1/2004 Faull ..... 324/761

* cited by examiner

*Primary Examiner*—Ross Gushi
*Assistant Examiner*—Phuongchi Nguyen
(74) *Attorney, Agent, or Firm*—Barbara R. Doutre

(57) ABSTRACT

A connector (100) having multiple contacts (102) includes a supply contact (104), a ground contact (106) and at least one other contact (108) for providing attach/detach detection to an accessory or accessory connector. The supply and ground contacts (104, 106) are longer than the detect contact (108) so that power is connected prior to any of the other contacts and power is removed after any of the other contacts are detached. Logical control circuitry (318) interfaces with the connector (100) to minimize sparks upon detachment from the accessory (304).

7 Claims, 2 Drawing Sheets

100

200

300

APPARATUS FOR INTRINSICALLY SAFE POWER INTERFACE

TECHNICAL FIELD

This invention relates in general to connectors, and more particularly to intrinsically safe connectors.

BACKGROUND

Many of today's portable radio products are required to meet a Factory Mutual Intrinsically Safe rating. The purpose of this rating is to prevent ignition of an explosive atmosphere while operating electrical devices within such an environment. Sparking at connectors, for example, must be limited to sufficiently low energy that flammable atmospheres will not ignite. To guarantee meeting the intrinsically safe rating in today's radio products, an internal resistor is placed in series with the battery supply for the accessory power available at the accessory connector. While the resistor allows the radio to be intrinsically safe, it also limits the available power to an accessory, preventing the deployment of high power accessories, such as GPS and large displays with backlighting.

The universal serial bus (USB) interface was designed as a "hot-swappable" connector which enables peripherals to be connected to a host, such as a personal computer (PC), without powering down the system. The USB connector follows an industry standard for low power peripherals. The power contacts in the USB connector contact first and detach last, but the USB system does not guarantee turning off the power for purposes of preventing hazardous sparking.

Accordingly, there is a need for a means for a radio to supply higher power to an accessory across an accessory connector while still preventing sparks of sufficient energy to ignite a hazardous atmosphere.

BRIEF DESCRIPTION OF THE DRAWINGS

The features of the present invention, which are believed to be novel, are set forth with particularity in the appended claims. The invention, together with further objects and advantages thereof, may best be understood by reference to the following description, taken in conjunction with the accompanying drawings, in the several figures of which like reference numerals identify like elements, and in which:

DETAILED DESCRIPTION OF THE PREFERRED EMBODIMENT

Figure 1:
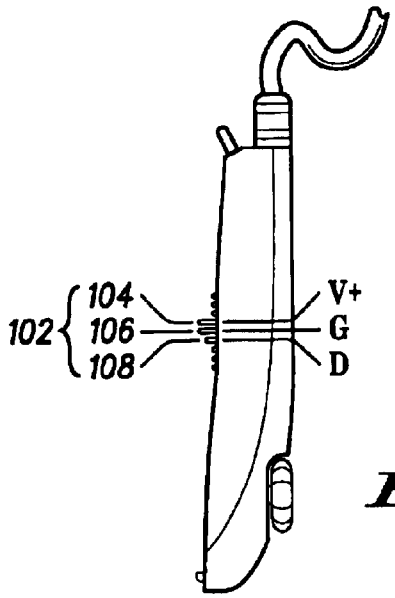
FIG. 1 is a connector formed in accordance with the present invention.

While the specification concludes with claims defining the features of the invention that are regarded as novel, it is believed that the invention will be better understood from a consideration of the following description in conjunction with the drawing figures, in which like reference numerals are carried forward.

In accordance with the present invention, there is provided herein an intrinsically safe power interface system that provides a means for a radio to supply higher power to an accessory across an accessory connector while still preventing sparks of sufficient energy to ignite a hazardous atmosphere.

FIG. 1 is a connector 100 formed in accordance with the present invention. Connector 100 includes a plurality of contacts 102 including a voltage supply contact 104, a ground contact 106, and in accordance with the present invention, at least one other contact for providing attach/detach detection, shown here as detect contact D 108. In accordance with the present invention, the supply and ground contacts 104, 106 are longer (have greater spring loaded extension) than the detect contact 108. The power supply contacts 104, 106 are formed having a first predetermined length of accommodation of connector component separation and the detect contact 108 is formed having a second predetermined length of accommodation of connector component separation, the second predetermined length being shorter than the first predetermined length.

Figure 2:
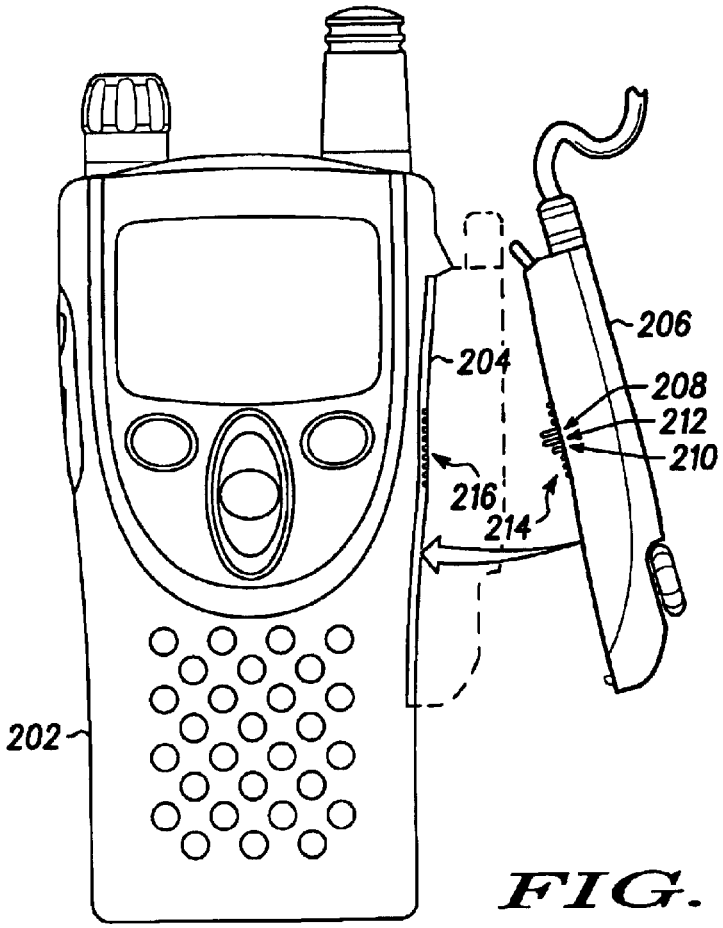
FIG. 2 is a connector interface system formed in accordance with the present invention.

FIG. 2 is a connector interface system 200 formed in accordance with the present invention. The interface system 200 is shown between a communication device 202, such as a radio having a communication device connector 204, and an accessory connector 206 for mating with the communication device connector 204. The accessory connector 206 comprises a plurality of pins 214 including a supply pin 208, a detect pin 210 and a ground pin 212. Corresponding mating contact elements are located on the radio 202. In accordance with the present invention, the supply pin 208 and the ground pin 212 connect to the communication device connector 204 prior to the detect pin 210 when the accessory connector 206 is mated with the communication device connector, and the supply pin 208 and the ground pin 212 disconnect after the detect pin 210 when the accessory connector 206 is removed from the communication device connector 204. In accordance with the present invention, the power pins 208, 212 have greater accommodation of separation than detect (D) pin(s) 210. Thus, the power pins 208, 212 are first to contact and last to disconnect. The detect pin (D) 210 contacts last upon attachment of the two connectors 204, 206 and disconnects first upon detachment of the two connectors. In accordance with the present invention, logic control circuitry within radio 202 electronically disconnects the voltage source from the V+ pin 208 immediately upon detachment of the detect pin 212 from the radio 202. Thus, the power is turned off to the accessory V+ pin 208 prior to detachment thereby preventing any sparking upon detachment of the V+ pin 208 from device connector 204.

The connector of the present invention can be utilized in an interface system that comprises a first connector having contacts, a second connector for attaching and detaching to the first connector, the second connector having corresponding contacts for mating with the contacts of the first connector, the corresponding contacts including power contacts that make contact with the first connector prior to other corresponding contacts upon attachment and break contact with the first connector after the other corresponding contacts upon detachment. The power contacts can comprise DC and AC sources. For example the power pins can be DC power, high power audio, or other source capable of generating sparks.

The connectors 204, 206 of the present invention are preferably formed using well known mechanical techniques including sealing the contact area against air flow and water intrusion and confinement such that the contacts do not intermittently connect and disconnect with vibration. In the preferred embodiment of the invention, the mating radio connector 204 is preferably formed of a planar array of stationary contacts 216 which do not move. The contacts 214 on the accessory side of the connector pair 204, 206 are—telescoping spring loaded contacts, such as pogo pins known in the art. In prior art connector systems, there is by design some accommodation of variable length in the contacts so that all contacts are guaranteed to simultaneously connect to a corresponding surface once the connector has been established into it final "mated" position. In accordance with the present invention, by forming the power pins 208, 212 of spring loaded telescoping style contacts on the accessory connector having greater telescoping length (accommodation) than the detect pin 210, the detect pin 210 will serially detach from its mating contact on radio 202 prior to either of the power pins 208, 212 detaching from their mating contacts 216 as connector 206 is removed from radio 202.

The use of spring loaded contacts allows multiple contacts to simultaneously mate when the connector is in its "attached" position. The use of longer length telescoping spring loaded contacts, in accordance with the invention, allows the contacts to serially connect/disconnect as the connector assembly is brought into its attached position/being removed from its attached position. If the contacts were all the same length the disconnect would still be serial, but the order may be somewhat random, and there would not be necessarily any or enough time between the detach pin disconnect and the supply disconnect. Lengthening the accommodation of the power pins in accordance with the present invention provides a guaranteed order of connection and provides timing margin.

Figure 3:
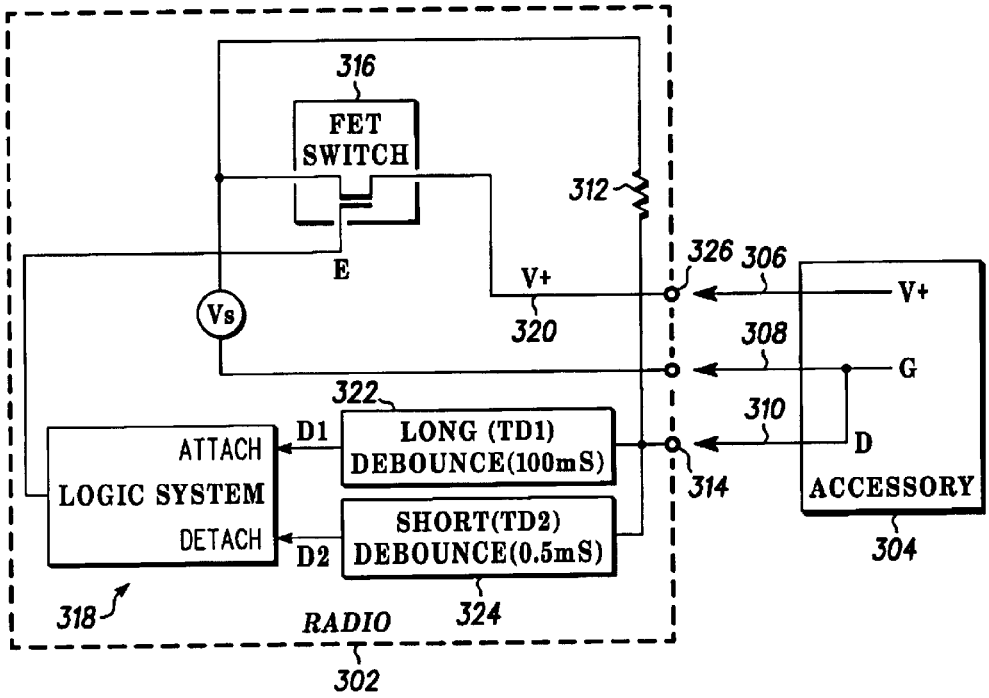
FIG. 3 is an electrical block diagram of a logical control circuit for accessory detection in the accessory interface system in accordance with a preferred embodiment of the invention.

Referring now to FIG. 3, there is shown an electrical block diagram of a logical control circuit for accessory detection in the accessory interface system in accordance with a preferred embodiment of the invention. System 300 includes a radio 302 and accessory 304 having power contacts 306, 308 and detect pin 310.

In accordance with the preferred embodiment, radio 302 pulls the detect pin 310 of the accessory (or accessory connector) 304 to a positive logic supply 320 with a high value resistor 312, such as 10 kohms (or current source). The voltage presented at the radio side connector 314 to the detect pin 310 is intrinsically safe to due to the low value of short circuit current from the high value of series resistance. Within the radio 302, the detect pin's raw signal state (D) is passed through a long debounce circuit (TD1, analog or digital) 322 whose output (D1) is monitored as an attachment indicator. Without a valid connector attached, the state of D1 will appear to be a logic high. The accessory connector 304 is designed to electrically short the detect pin (D) 310 to ground within the accessory or accessory connector 304. Thus, when the accessory connector 304 is attached to the radio 302, the connections within the accessory will complete a circuit, shorting D to ground. After a long debounce period, TD1 (such as 100 mS), the radio 302 will determine the long debounced state (D1) to be a logic low. Upon receiving a logic low indication at D1, the radio determines that an accessory connector is stably attached (accessory attachment is detected). Once this detection has occurred, the radio 302 may also apply additional means to verify that an acceptable accessory is attached and may read from the accessory. When the accessory 302 is detached, a short debounce circuit (TD2) 324 will very quickly (for example, in less than 0.5 mS) determine that raw state D 314 has changed from a logic low to a logic high. Thus, signal D2 will be a logic high after no more than, for example, 1 mS. When D2 is a logic high, detachment is detected. Note that no power need be applied to radio contact V+ 326 for attachment or detachment to be detected.

In accordance with another embodiment of the invention, power turn-on only occurs when a valid accessory has been detected. Once the radio 302 detects a long debounced (TD1) logic low (D1), stable attachment is detected (further verification of acceptable accessory may have been performed) and the logic may enable the power to be applied to the V+ pin by enabling signal E to turn on the FET switch 316 in this example. Turning on the FET switch 316 will supply Vs to the V+ pin and thus supply power to the accessory 304. When no accessory is attached, no power is applied to the exposed radio connector and there is no potential for a dangerous spark by inadvertent metallic contact. When the accessory is stably attached, the power that is applied to the V+/G may be far in excess of what is safe to "break" in an uncontrolled fashion within a flammable atmosphere.

The logic system control 318 turns off the voltage at V+ immediately upon detach detect. Detach detection occurs very rapidly (<1 mS) when the detect pin, D, 310 disconnects. Note again that D pin 310 is a shorter pin than power supply pins V+ and G 306, 308, and hence there is time for the logic system 318 to turn the FET switch 316 off (via signal E) before the power supply pins V+ and G disconnect from their mating contacts. A typical time difference between disconnection of D and disconnection of longer throw contacts V+ and G is, for example, 5–10 mS. Shutoff of the power via E and the FET switch 316 can easily occur in 1 mS. Thus, by the time contact is broken with either the V+ or G pin, the source has long since been turned off and there is no potential for a high current spark. Implementation of the logic control system 318 to disable the FET switch 316 (to turn off the power) is preferably implemented in hardware for maximum reliability and highest speed. Other implementations of logic control circuitry can be achieved through a microprocessor and software; however, the hardware implementation is preferred.

Accordingly, there has been provided an intrinsically safer power interface system in which the power is turned off while the accessory connector power pins are attached or detached without the user having to provide any advance signaling of his intentions to attach or detach. The use of extended power pins and at least one detach detect pin allow for power to be turned on only when a valid accessory is detected. The ability to turn off power before the power pins detach using a separate pin and logic system to detect detachment prior to power pin disengagement prevents sparking in a system which must remain intrinsically safe. Thus, the interface system of the present invention allows a radio to supply higher power to an accessory across an accessory connector while preventing sparks of sufficient energy to ignite a hazardous atmosphere.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. An interface assembly for a communication device, the interface assembly comprising:

a communication device connector;

an accessory connector for mating with the communication device connector, the accessory connector comprising:

a supply pin;

a detect pin;

a ground pin;

the supply pin and the ground pin connecting to the communication device connector prior to the detect pin connecting to the communication device connector when the accessory connector is mated with the communication device connector, and the supply pin and the ground pin disconnecting from the communication device connector after the detect pin disconnects from the communication device connector when the accessory connector is removed from the communication device connector, the disconnection of the detect pin causing power to turn off at the supply pin prior to disconnection of the supply pin thereby preventing sparking.

2. The interface assembly of claim 1, wherein the communication device comprises logic circuitry for detecting the presence of the detect pin.

3. The interface assembly of claim 1, wherein the communication device comprises logic circuitry that senses attachment and detachment of the accessory connector to the communication device connector through the detect pin.

4. The interface assembly of claim 3, wherein the communication device comprises a radio.

5. A connector for interfacing to a communication device, the connector comprising:

a plurality of contacts formed of pogo pins;

the plurality of contacts including power contacts and at least one other contact; and the power contacts having a first predetermined length of accommodation and the at least one other contact having a second predetermined length of accommodation shorter than the first; and the at least one other contact serially detaching from a corresponding mating contact on the communication device prior to the detachment of the power contacts, the detachment of the at least one other contact causing power to turn off at the plurality of power contacts prior to detachment of the plurality of power contacts from the communication device thereby preventing sparking.

6. The connector of claim 5, wherein the at least one other contact is used to provide attach/detach detection for the connector.

7. The connector of claim 5, wherein the power contacts accommodate sources from the communication device capable of generating a spark.

* * * * *